US009776688B1

(12) United States Patent
Underwood

(10) Patent No.: US 9,776,688 B1
(45) Date of Patent: Oct. 3, 2017

(54) LOW PROFILE TETHERING DEVICE FOR SECURING A BOAT

(71) Applicant: Rock N. Underwood, Chapin, SC (US)

(72) Inventor: Rock N. Underwood, Chapin, SC (US)

( * ) Notice: Subject to any disclaimer, the term of this patent is extended or adjusted under 35 U.S.C. 154(b) by 0 days.

(21) Appl. No.: 15/153,944

(22) Filed: May 13, 2016

Related U.S. Application Data

(60) Provisional application No. 62/160,806, filed on May 13, 2015.

(51) Int. Cl.
*B63B 21/20* (2006.01)
*B63C 15/00* (2006.01)

(52) U.S. Cl.
CPC ..... *B63B 21/20* (2013.01); *B63C 15/00* (2013.01)

(58) Field of Classification Search
CPC ..... B66D 1/30; B63B 21/04
See application file for complete search history.

(56) References Cited

U.S. PATENT DOCUMENTS

| | | | | |
|---|---|---|---|---|
| 4,278,042 | A | 7/1981 | Lindquist | |
| 4,697,537 | A | 10/1987 | Smith | |
| 4,846,090 | A | 7/1989 | Palmquist | |
| 5,931,112 | A | 8/1999 | Lacan | |
| 6,095,075 | A * | 8/2000 | Gordon | B63B 21/04 114/230.23 |
| 7,325,509 | B2 | 2/2008 | Gordon et al. | |
| 8,413,599 | B2 | 4/2013 | Underwood | |

FOREIGN PATENT DOCUMENTS

| | | | |
|---|---|---|---|
| JP | 10183578 | A | 7/1998 |
| KR | 100607881 | B1 | 8/2006 |
| WO | 0102241 | A1 | 1/2001 |

OTHER PUBLICATIONS

Webpage ezCLEAT from http://ezcleat.com/gallery.html Apr. 2011.
Webpage linedudes from http://linedudes.com/ Apr. 2011.
Webpage Worth Company 19000 Moormate Marine Recessed Boat Cleat With Retractable Rope from http://www.amazon.com/Worth-Company-19000-Moormate-Retractable/ Apr. 2011.
Search Report from Corresponding PCT application WO 2009/143029 A3 Nov. 26, 2009.

* cited by examiner

*Primary Examiner* — Edwin Swinehart
(74) *Attorney, Agent, or Firm* — Nexsen Pruet, LLC; Michael A. Mann

(57) ABSTRACT

A tethering device for use in securing a boat to a dock is mounted to the underside of the dock decking with its deck trim assembly flush with the top of the dock and only the looped, running end of the tethering line extending from a hole in its deck trim assembly. Threaded studs welded to the underside to the deck trim assembly enable its line retraction mechanism and line locking mechanism to be supported below the decking leaving the deck surface free of tripping hazards and excess line. Below the decking, an assembly cover houses a self-retracting reel and a line-locking mechanism for control over the line, retracting excess line but enabling the user to set and hold the length of line needed for tethering a boat to the dock.

20 Claims, 11 Drawing Sheets

LOW PROFILE TETHERING DEVICE FOR SECURING A BOAT

TECHNOLOGICAL FIELD

The disclosure relates generally to boat docks. In particular, the disclosure relates to devices for tethering boats to docks.

BACKGROUND OF THE DISCLOSURE

The present disclosure relates to devices for tethering watercraft, such as boats, to docks. Currently, the most common way for a boat to be secured to a dock is to wrap a rope running from a boat around a cleat on a dock. A cleat is a device with a base fastened to the decking surface of the dock and two prongs extending laterally from opposing sides of the base. A rope may be looped in a figure eight pattern or lashed in some other manner around the two opposing prongs to secure the boat to the cleat and thereby to the dock.

There are several shortcomings in the use of cleats. Primarily the cleats together with a mass of rope used to tether the boat are a tripping hazard to those walking on the dock. The oftentimes casual manner in which ropes are wrapped around cleats on docks is ironic in view of the care generally taken by boat owners when securing gear on their boats in order to eliminate tripping hazards. Also, as docks weather, the security of the cleat's moorings becomes an insidious issue because a cleat may look secure, but the wood holding it may have rotted. Thus there remains a need for a better way to tether a boat to a dock.

SUMMARY

This disclosure describes a tethering device for use in securing a boat to a dock. The device is mounted to the underside of the decking of the dock but with its deck trim assembly flush with the top of the dock so only the looped, running end of the tethering line extends above the decking through a hole in the deck trim assembly. Threaded studs are welded to the underside to the deck trim assembly to enable the device's retraction mechanism and its line locking mechanism to be supported below the decking thereby leaving the deck surface free of tripping hazards and excess line. Below the decking, an assembly cover houses a self-retracting reel and a line-locking mechanism for control of the line, the first retracting excess line and the second enabling the user to set and hold the appropriate length of line for tethering the boat to the dock.

An aspect of the disclosure is a tethering device for use with a boat dock. The tethering device includes a line with a running end having a loop formed in it; a retracting reel deploying that line when force is applied to the running end and retracting the line when no force is applied; a reel frame that holds the retracting reel; a dock board having a top surface and a bottom surface to which the reel frame is secured, and with a hole is formed in the dock board through which the running end of the line runs from the retracting reel to the top surface of the dock board; a latch arm carried by the dock board and having a top surface and a bottom surface, a latched position and an unlatched position; a cam connected to the latch arm at a point proximate to the line between the retracting reel and the hole in the dock board so that, when the latch arm is moved to the latched position, it moves the cam into engagement with the line, holding it against movement so that, and when the latch arm is moved to the unlatched position, it moves the cam away from the line so that the line can be retracted by the retracting reel unless force is applied to the line resisting retraction; a deck trim assembly having a top surface and a bottom surface with a recess formed in the top surface configured and dimensioned to receive the dock board. When the dock board is in the, the top surface of the dock board is flush with the top surface of the deck trim assembly. Threaded studs secured to the bottom surface of the deck trim assembly are long enough to pass through decking of a boat dock so they can be secured from underneath the decking.

Another aspect of the disclosure is that the dock board also has a recess formed therein for the latch arm when in the latched position, and the top surface of the latch arm is then flush with the top surface of the dock board and the top surface of the deck trim assembly.

Still another aspect of the disclosure is that the cam is configured to have teeth to grip the line.

Yet another aspect of the tethering device is that the dock board has a with that is the same as the width of the decking boards of which the dock is made.

A further aspect of the tethering device is that the deck trim assembly extends partially over adjacent decking boards with the dock board fitting in the recess of the deck trim assembly fitted between two parallel, spaced apart decking boards.

Another aspect of the tethering device is an assembly cover secured to the bottom surface of the dock board and surrounding and housing the retracting reel, the reel frame, and the cam.

An aspect of the tethering device is an arm mount located proximate to the cam and having two parallel flanges. The line runs between the two parallel flanges, confined laterally, from the retracting reel to the hole in the dock board.

Still another aspect of the tethering device is that the latch arm includes a plunger and a locking arm. The locking arm has a distal end and a proximal end that carries the cam. The plunger engages the distal end of the locking arm and pivots the proximal end of the locking arm when it presses the distal end of the locking arm thereby bringing the cam into engagement with the line when the latch arm is moved from the unlatched position to the latched position.

An aspect of the disclosure is a tethering device with a line having a fixed end and a running end, and the running end having a loop formed in it; a deck trim assembly with a top surface and a bottom surface and a recess formed in the top surface, a dock board dimensioned and configured to be received in the recess of the deck trim assembly, the dock board having a top surface and a bottom surface, and wherein, when the dock board is in the recess of the deck trim assembly, the top surface of the dock board is flush with the top surface of the deck trim assembly, and the top surface of the deck trim assembly extends laterally from the recess to define a flange, the dock board having a hole formed therein through which the line passes, with the running end above the top surface and the fixed end of the line below the bottom surface of the dock board; an assembly cover secured to the bottom surface of the dock board; a retracting reel inside the assembly cover which reel deploys the line when force is applied to the running end, and retracts the line when no force is applied, the fixed end of the line being attached to the retracting reel; a reel frame inside the assembly cover and secured to the bottom surface of the dock board and the retracting reel is secured to the reel frame; a latch arm carried by the dock board and having a latched position and an unlatched position, a proximal end and a distal end; and a cam connected to the proximal end of the latch arm at a point between the retracting reel and the hole in the dock board so that, when the latch arm is moved to the latched position, it moves the cam to engage and hold the line against movement, and when the latch arm is moved to the unlatched position, the latch arm moves the cam away from the line so that the line moves toward the retracting reel unless another force is applied to the line.

An aspect of the disclosed tethering device is that the dock board has a width that is the same as the width of a decking board.

Another aspect of the disclosed tethering device is that the deck trim assembly is securable to several decking boards of a boat dock.

Still another aspect of the disclosed tethering device is that the deck trim assembly has plural threaded studs attached to its bottom surface.

Yet another aspect of the disclosure is that the retracting reel includes a spool with the line wound to it. The spool has a hole formed in it that includes a narrower slot. The fixed end of the line has a knot tied in it that will pass through the hole but not the narrower slot.

An aspect of the disclosure is a tethering device that has a line having a fixed end and a running end with a loop in the running end; a deck trim assembly that has a top surface and a bottom surface with a recess formed in the top surface, a dock board dimensioned and configured to be received in the recess of the deck trim assembly. The dock board has a top surface and a bottom surface. When the dock board is in the recess of the deck trim assembly, the top surface of the dock board is flush with the top surface of the deck trim assembly, and the top surface of the deck trim assembly extends laterally from the recess to define a flange. The dock board also has a hole in it for the line with the running end above the top surface and the fixed end below the bottom surface. The device has an assembly cover secured to the bottom surface of the dock board, and a retracting reel inside the assembly cover. The retracting reel deploys the line when force is applied to the running end of the line and retracts the line when no force is applied. The fixed end of the line is attached to the retracting reel. A reel frame is secured to the bottom surface of the dock board inside the assembly cover, and the retracting reel is secured to the reel frame. A hole is formed in the dock board through which the running end of the line passes from the retracting reel to the top surface of the dock board. A latch arm, carried by the dock board, has a latched position and an unlatched position. When the latch arm is moved to the latched position, the latch arm holds the line against movement, and when the latch arm is moved to the unlatched position, the line moves toward the retracting reel unless force is applied to the running end of the line.

Yet another aspect of the disclosed tethering device of claim 13, further comprising a locking arm pivotally connected to the latch arm, so that when the latch arm moves between the latched position and the unlatched position, the locking arm pivots between a position toward the line and away from the line, and wherein the proximal end of the locking arm carries a cam that engages the line when the locking arm moves toward the line and disengages from the line when the locking arm moves away from the line.

Another aspect of the disclosed tethering device is a plunger carried by the dock board. The plunger couples the latch arm to the locking arm so that the plunger pushes the distal end of the locking arm down as the latch arm moves to the latched position from the unlatched position, and plunger allows the distal end of the locking arm to rise when the latch arm is moved to the unlatched position.

A further aspect of the disclosure is that the low-profile, flush, upper surface of the device eliminates the tripping hazard of cleats, and the retraction reel eliminates the mass of excess line. The result is a neater appearance and certainly safer than the use of prior art cleats.

Yet another aspect of the disclosure is the internal line locking mechanism helps to assure that the line is securely fastened and remains securely fastened to the device at the length pre-determined by the user without slipping or play-out of the line over time.

These and other features and their advantages will be readily apparent to those skilled in the art in tethering small craft to docks and marinas from a careful reading of the Detailed Description of Preferred Embodiments, accompanied by the following drawings.

BRIEF DESCRIPTION OF THE DRAWINGS

In the figures.

DETAILED DESCRIPTION

Figure 1:
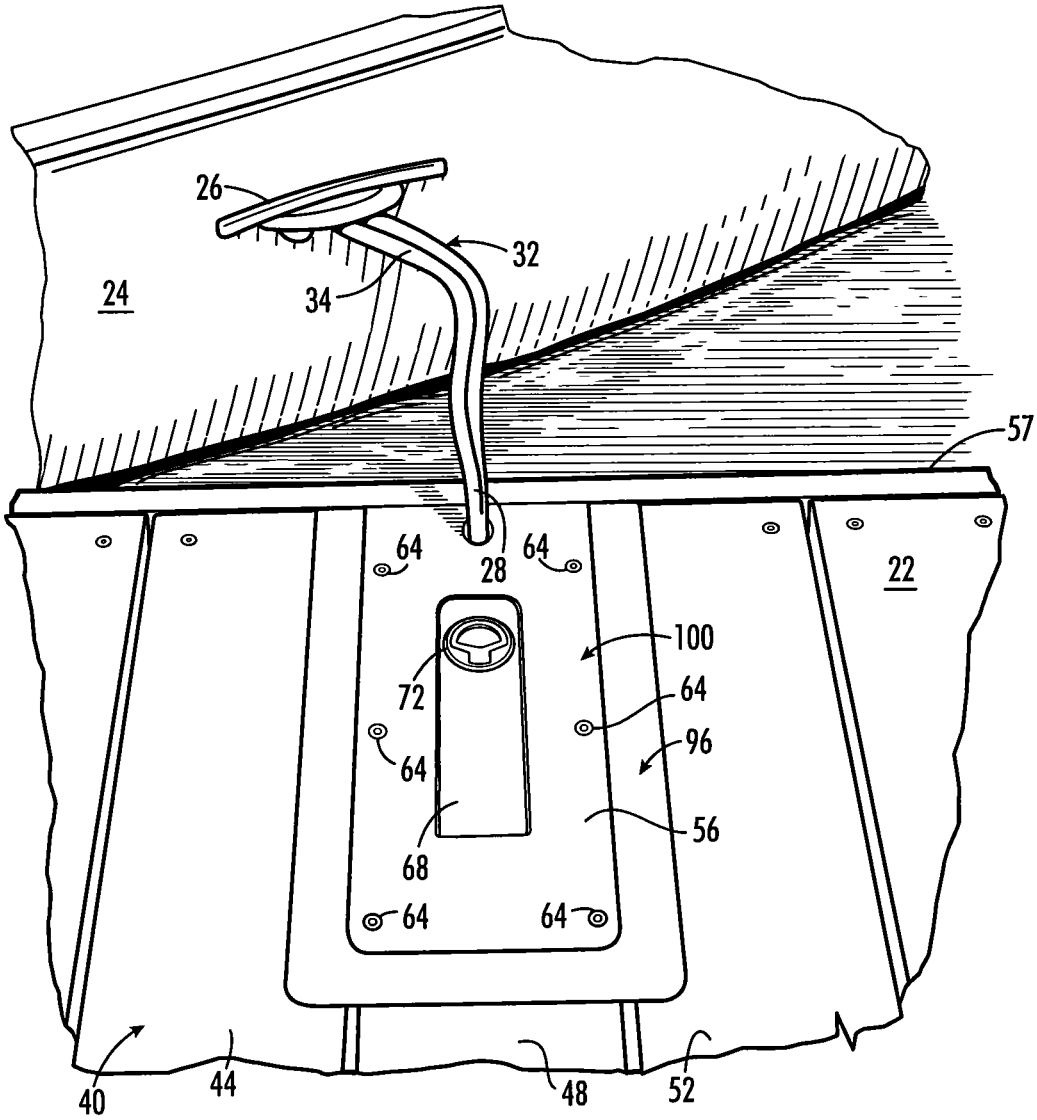
FIG. 1 is a rear, upper perspective view of the tethering device installed in a dock, showing a part of a dock with a part of a boat tethered to the tethering device, according to an aspect of the disclosure.

FIG. 1 illustrates the present device 20 from the rear and therefore the use of the term proximal as used herein will mean closer to the front of device 20 and distal as used herein will mean farther from the front of device 20. As illustrated in FIG. 1, a device 20 for tethering a boat 24 or other water craft to a dock 22 is disclosed. Dock 22 comprises a framework, often made of treated wood but sometimes made with other materials, and covered with decking 40, which is typically treated wood or composite boards 44, 48, 52. Dock 22 may, for example, extend from a shoreline out into a body of water such as a lake or river. Dock 22 may be supported above the surface of the water by pilings or may be a floating dock. Dock enables the user of boat 24 floating on the water to walk between shore and floating boat 24 easily. Boat 24 is tethered to dock 22 so that it remains proximate to dock 22 by a convenient distance for its user to step from the deck of dock 22 onto the deck of boat 24.

Decking 40 may be made of deck boards 44, 48, 52, such as pine boards laid in parallel across the framework of dock 22 and fastened to that framework with nails or screws. Decking 40 may alternatively be made of a plastic, composite, or other rigid, durable, material.

Tethering device 20 may be incorporated into the surface of dock 22, as shown, by removing a part of a deck board, and is shown replacing a portion of the end of a deck board 48 of decking 40 to be flush with the top of decking 40 when installed so that it does not present a tripping hazard. Installation then requires cutting deck board 48 at a predetermined point near but spaced apart from edge 54 of dock 22 so that device 20 may be inserted in place of the removed portion of deck board 48.

Dock 22 may have several of the present devices 20 installed at intervals along its edge 54 depending on how long dock 22 is and how many boats 24 may be tied up to dock 22. A marina dock may have a tethering device 20 every 20 feet, for example.

Each device 20 includes a line 28 that may have a loop 34 formed in the running end 32, preferably a spliced line loop 34 for use in hitching line 28 to a cleat 26 on boat 24 using, for example, a lark's head hitch as illustrated in FIG. 1. As used herein, the term "line" refers to rope or other thin, long, flexible material with sufficient tensile strength to secure a boat 24 to a dock 22 against currents and winds, and which line may be made of cotton, nylon, wire, cable, or other similar natural or synthetic materials.

Figure 2:
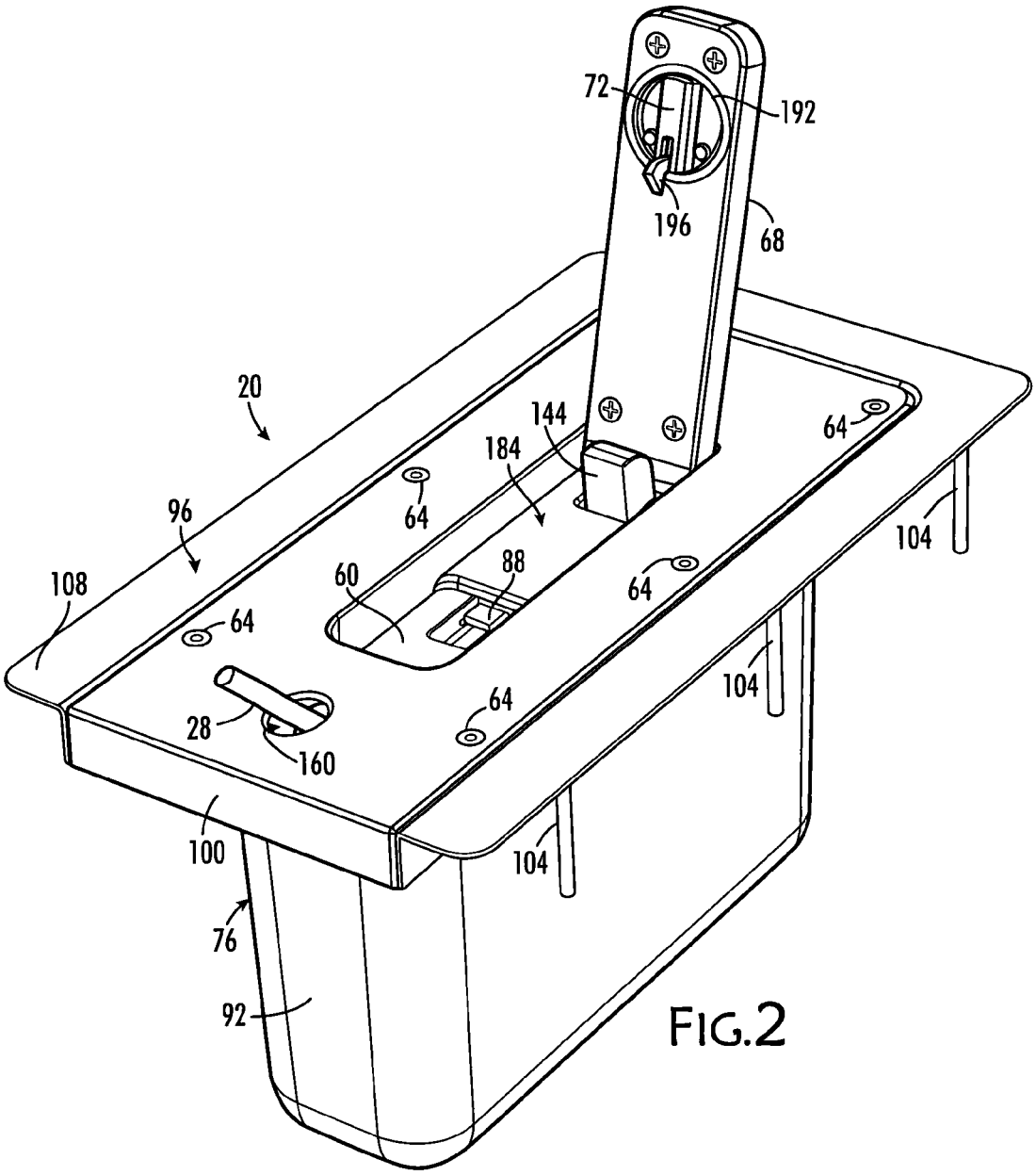
FIG. 2 is a left side, front perspective view, of the tethering device lifted from the dock to show the latch arm in an unlocked position and with a plunger in the fully up position, according to an aspect of the disclosure.

Device 20 is intended to provide a user-selectable length of line 28 for use in tethering boat 24 to dock 22. Device 20 may be installed in dock 22 so that it holds running end 32 of line 28 at the dock's edge 54. The user simply unlatches a latch arm 68 on device 20 by raising a latch 72 and lifting latch arm 68 as shown in FIG. 2 in order to release line 28. When line 28 is released, device 20, as will be described more fully below, will release its hold on line 28 so that loop 34 of running end 32 of line can be pulled away from device 20 easily. The user may then pull a selected length of line 28 sufficient to reach boat 24 where loop 34 of the running end 32 may be attached to a cleat 26 or to another part of boat 24. As will be explained herein, device 20 automatically retracts slack in line 28 to draw boat 24 toward dock 22.

When latch arm 68 is lowered to its latched position from its unlatched position and latch 72 is closed, device 20 grips the retracted line 28, preventing it from moving so that boat 24 cannot drift away from dock 22 beyond the pre-selected length of line 28 that has been selected by the user and which extends from device 20 when latch arm 68 was placed in the latched position. Latch arm 68 is shown in FIG. 1 in the latched position, which is flush with decking 40, and in the unlatched position in FIG. 2. Except when line 28 is being adjusted and latch arm 68 is in the unlatched, raised position, no part of device 20 extends significantly above decking 40 so as to present a tripping hazard and no pile of rope needs to clutter dock 22.

Figure 3:
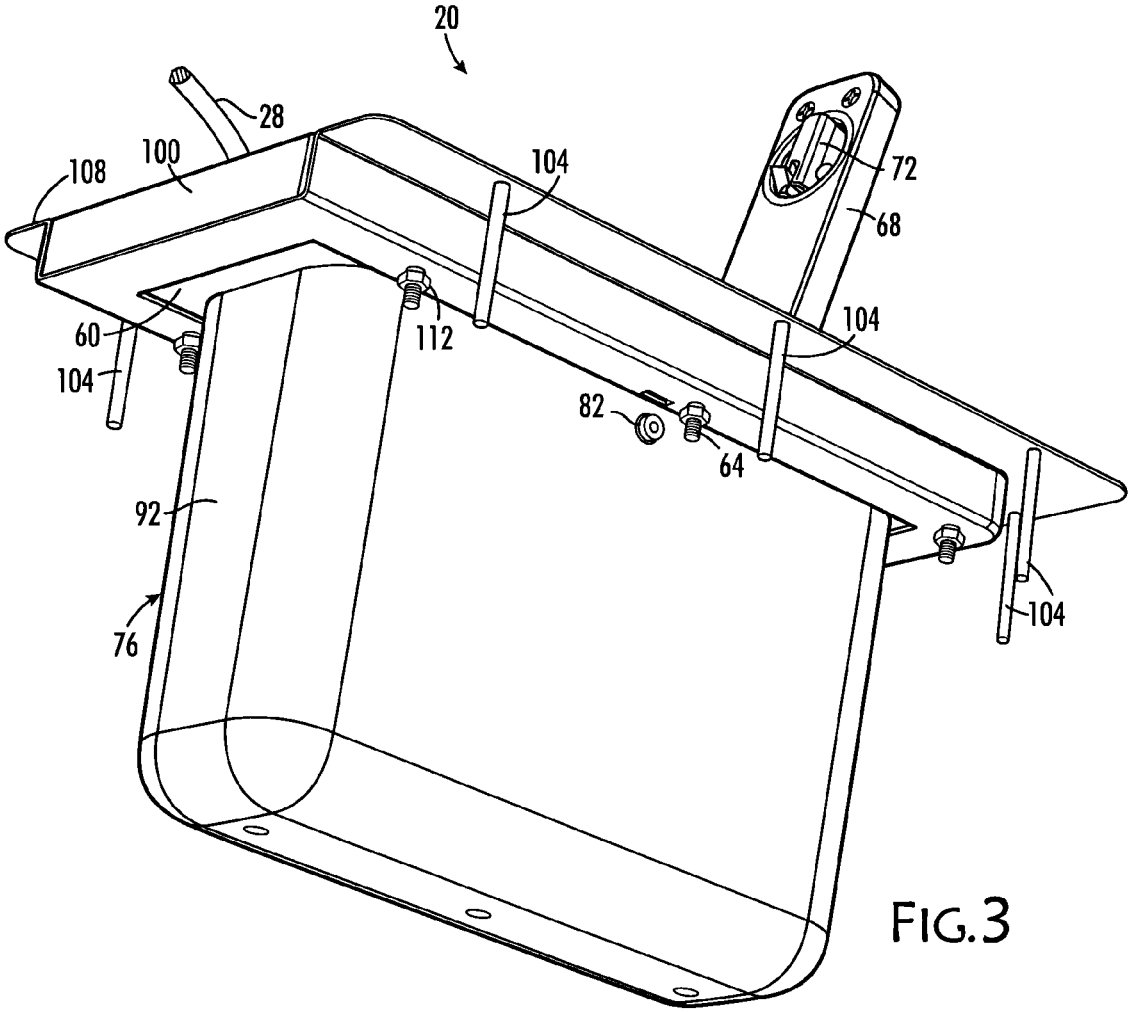
FIG. 3 is a left, lower front perspective view of the tethering device with latch arm in an unlocked, open position, showing the assembly cover and deck trim assembly with hidden mounting threaded studs, according to an aspect of the disclosure.

As best seen in FIGS. 2 and 3, device 20 includes an assembly cover 76 that protects the mechanisms inside from the elements, a deck trim assembly 96, and a dock board 100. Assembly cover 76 slides over a reel support frame and line lock mechanism, which are described below.

Figure 4:
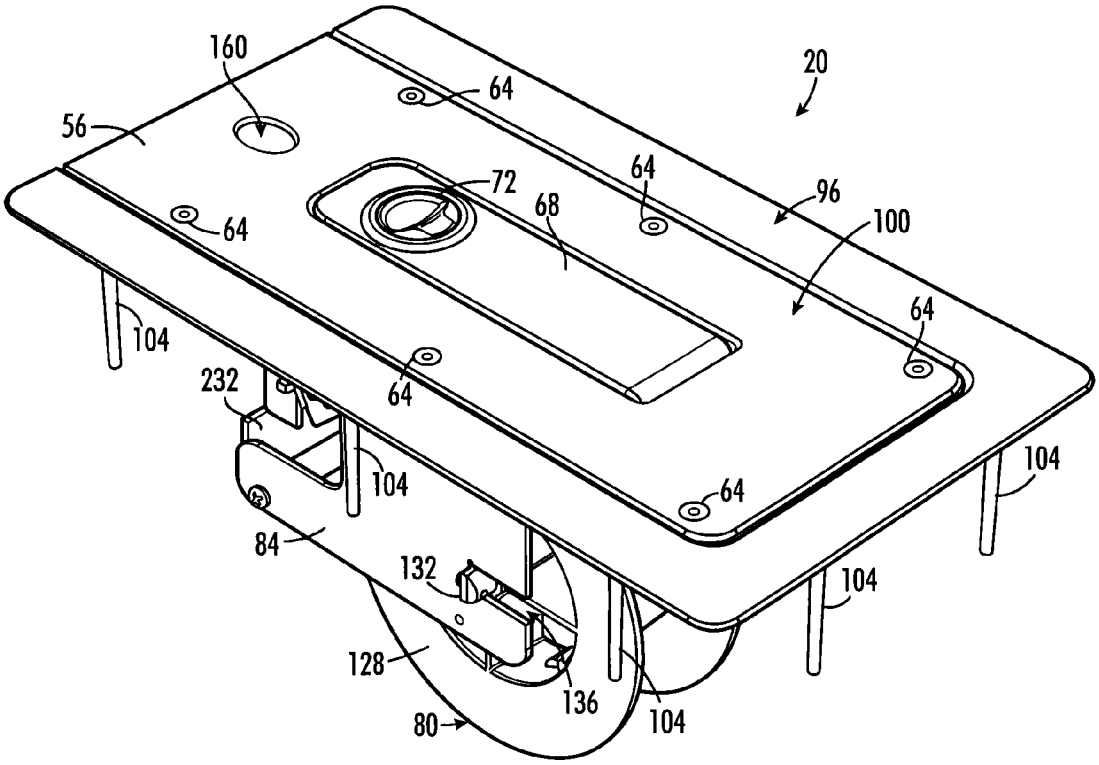
FIG. 4 is a left, upper rear perspective view of the tethering device, assembly cover removed, according to an aspect of the disclosure.

A proximal side 92 of assembly cover is intended to be parallel to and closest to edge 54 of dock 22 (see FIG. 1). Assembly cover 76 is fastened through and to reel support frame 84 by screws 82 as seen in FIGS. 3 and 4.

Deck trim assembly 96 is mounted to the surface of dock 22 by cutting deck board 48 short enough to allow a flush installation of deck trim assembly 96. Deck trim assembly 96 is mounted in place by drilling holes through deck boards 44, 48, 52, enabling hidden weld threaded studs 104 on the underside of a flange 108 on deck trim assembly 96 to go through the holes drilled in deck boards 44, 48, 52, and be fastened to the undersides of deck boards 44, 48, 52, with swivel nut plates 112 (see FIG. 11).

Figure 11:
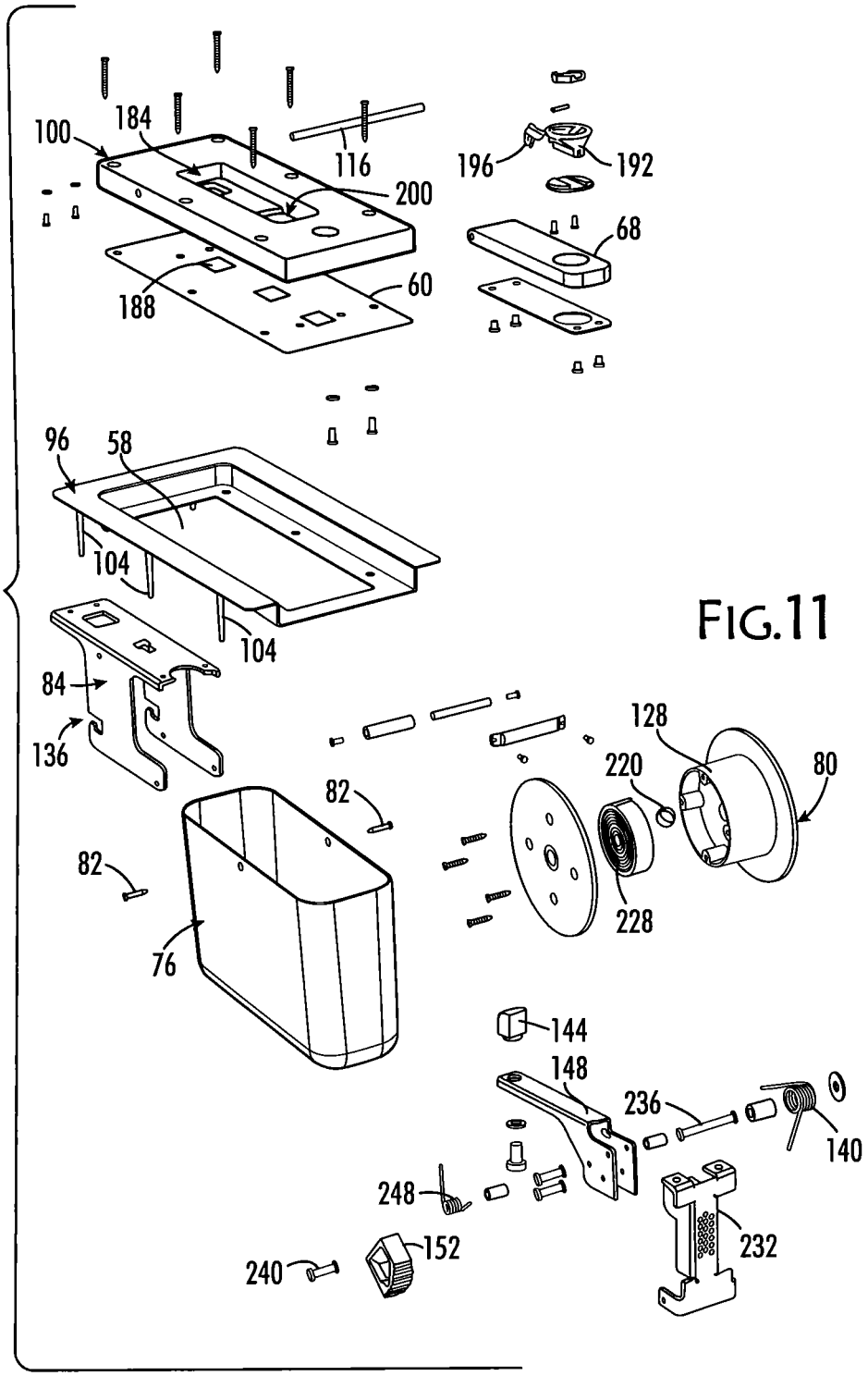
FIG. 11 is an exploded, left side, upper front perspective view of the tethering device, according to an aspect of the disclosure.

As best seen in FIG. 11, dock board 100 is seated in a recess 58 formed in deck trim assembly 96 with latch arm 68 and latch 72, which are hinged to dock board 100 with a pivot pin 116 and rests on a cover plate 60. Dock board 100 is attached to deck trim assembly 96 with screws 64 into swivel nut plates 112.

Deck trim assembly 96 hangs from the top surface of dock 22 via deck boards 44, 52, and allows tethering device 20 to be installed in a dock 22 despite different thicknesses of decking 40 and still remain flush with the top of that decking 40. Dock board 100 has a width that is the same as that of deck boards 44, 48, 52, which enables it to conveniently replace a portion of a single deck board 48 and not require more complicated fitting and piecing of deck boards. By "the same as" means simply that the width of dock board 100 and so much of deck trim assembly 96 on either side of dock board 100 will fit easily between two deck boards when the one between them is removed to leave a gap of one deck board plus the usual space between deck boards.

Figure 5:
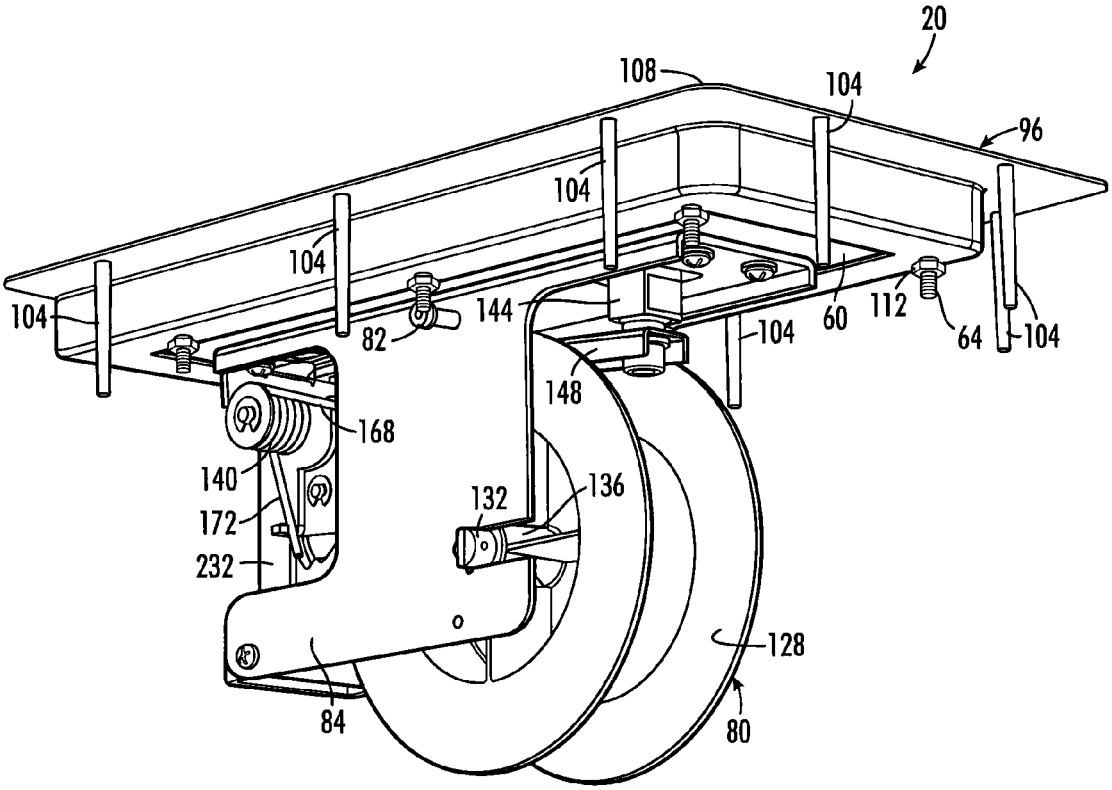
FIG. 5 is a left, lower rear perspective view of the tethering system, assembly cover removed, showing the reel support frame and reel with latch arm in the closed and latched position, according to an aspect of the disclosure.
Figure 6:
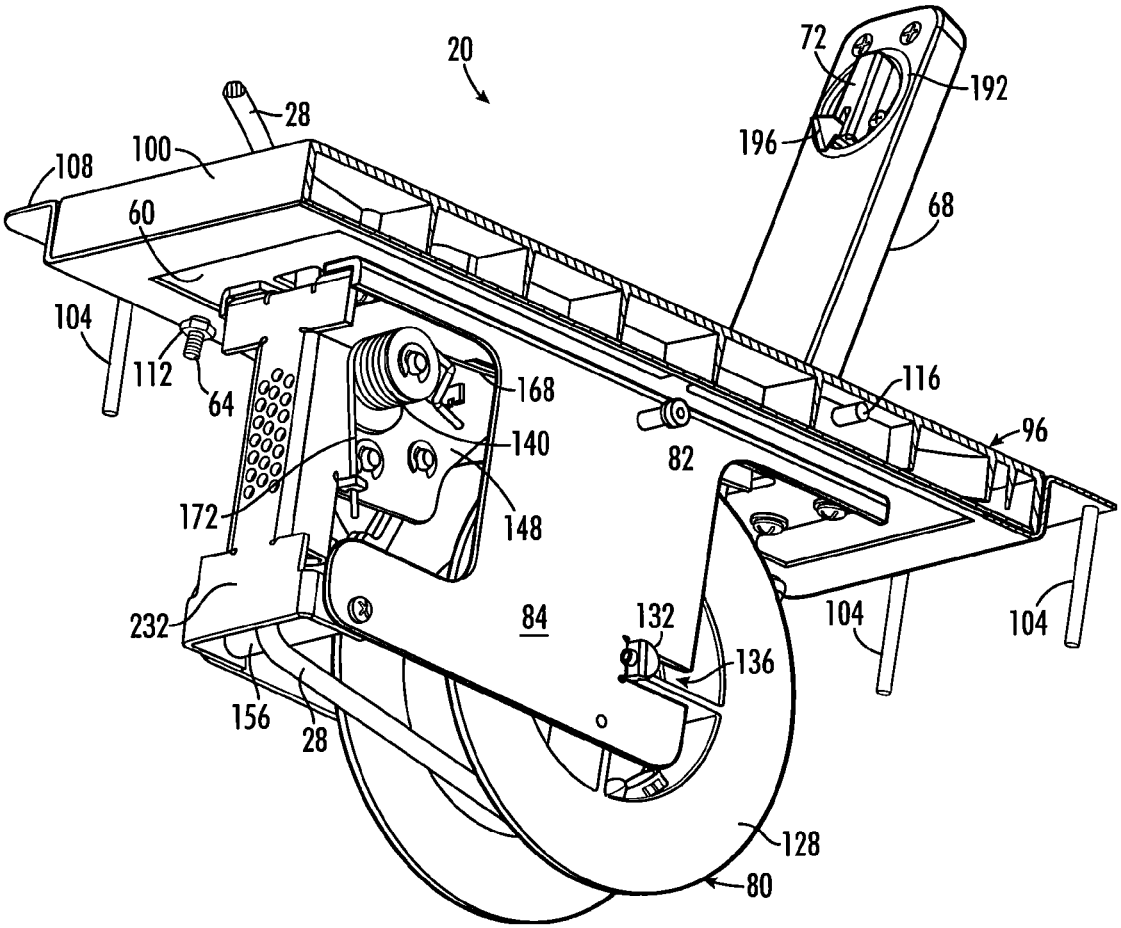
FIG. 6 is a left, partial cross-sectional, lower front perspective view of a of the present tethering device with assembly cover removed to show the reel support frame, reel, and line, with latch arm in the open and unlocked position, according to an aspect of the disclosure.

FIGS. 4, 5, and 6 illustrate device 20 with assembly cover 76 removed showing line spool 80 and reel support frame 84. All three figures are perspective views from the left side. FIG. 4 is an upper rear perspective view; FIG. 5 is a lower rear perspective view; and FIG. 6 is a lower front perspective view. Line 28 is visible in FIG. 6 coming off a reel 128. Reel has an axle 132 and reel support frame 84 has a slot 136 that receives an axle 132 for reel 128.

From FIGS. 5 and 6, a return spring 140 can be seen, the operation of which will be described presently, and plunger 144 which is depressed when latch arm 68 is in the latched position, as seen in FIG. 5, but which plunger 144 is raised when latch arm 68 is in the unlatched position, as seen in FIG. 6. Plunger 144, when pressed downward by lowering of latch arm 68, lowers distal end of a locking arm 148 to load return spring 140.

Figure 7:
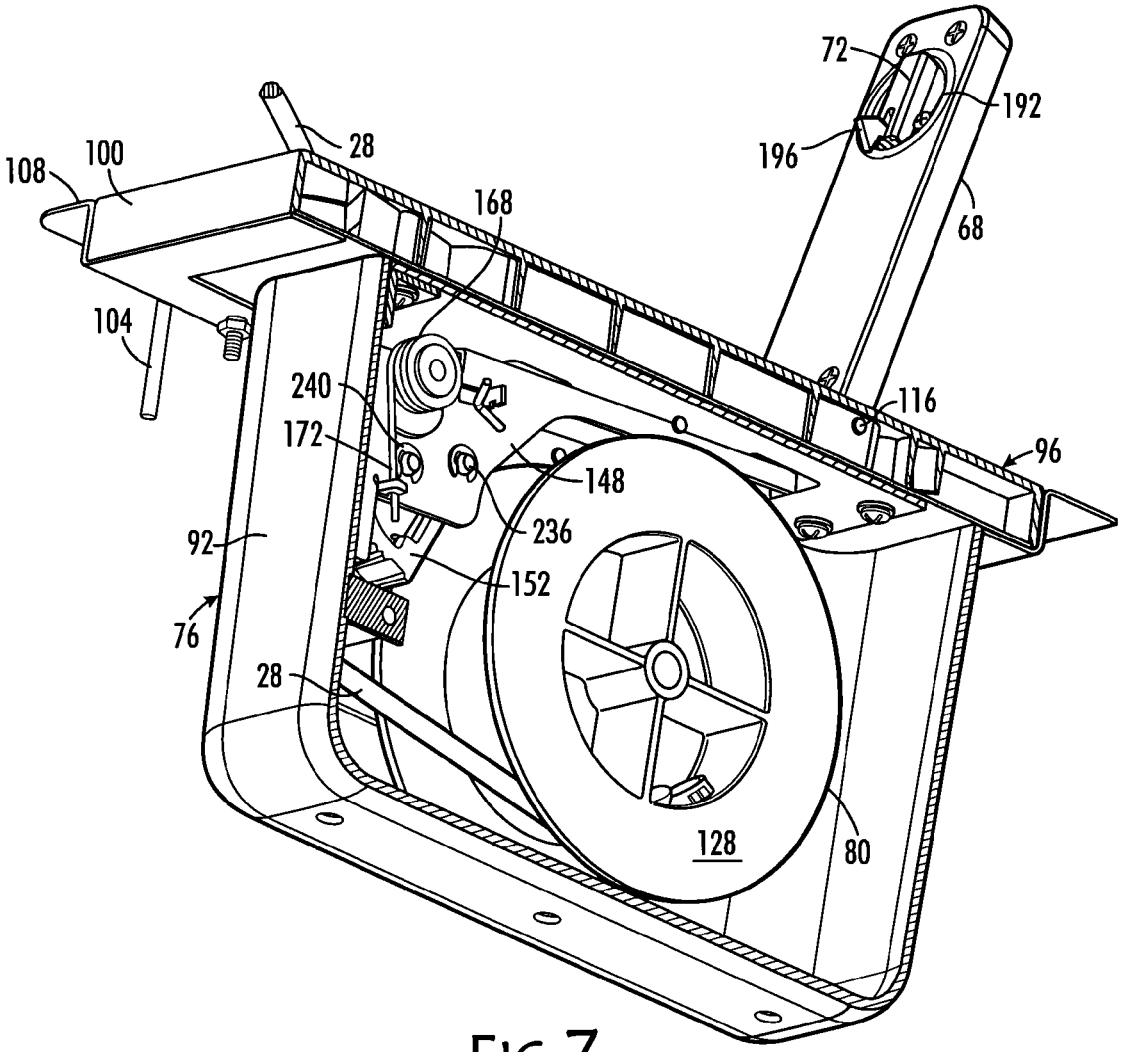
FIG. 7 is a left side, partial cross-sectional, lower front perspective view of tethering device, with latch up, according to an aspect of the disclosure.

As best seen in FIGS. 6 and 7, return spring 140, mounted to a peg 164, has two ends, a first end 256 that is engages locking arm 148 and a second end 260 that engages cam 152. Lowering latch arm 68 presses plunger 144 down that in turn presses a distal end 176 of locking arm 148 down and raises a proximal end 180 to lift cam 152 against line 28.

Figure 8:
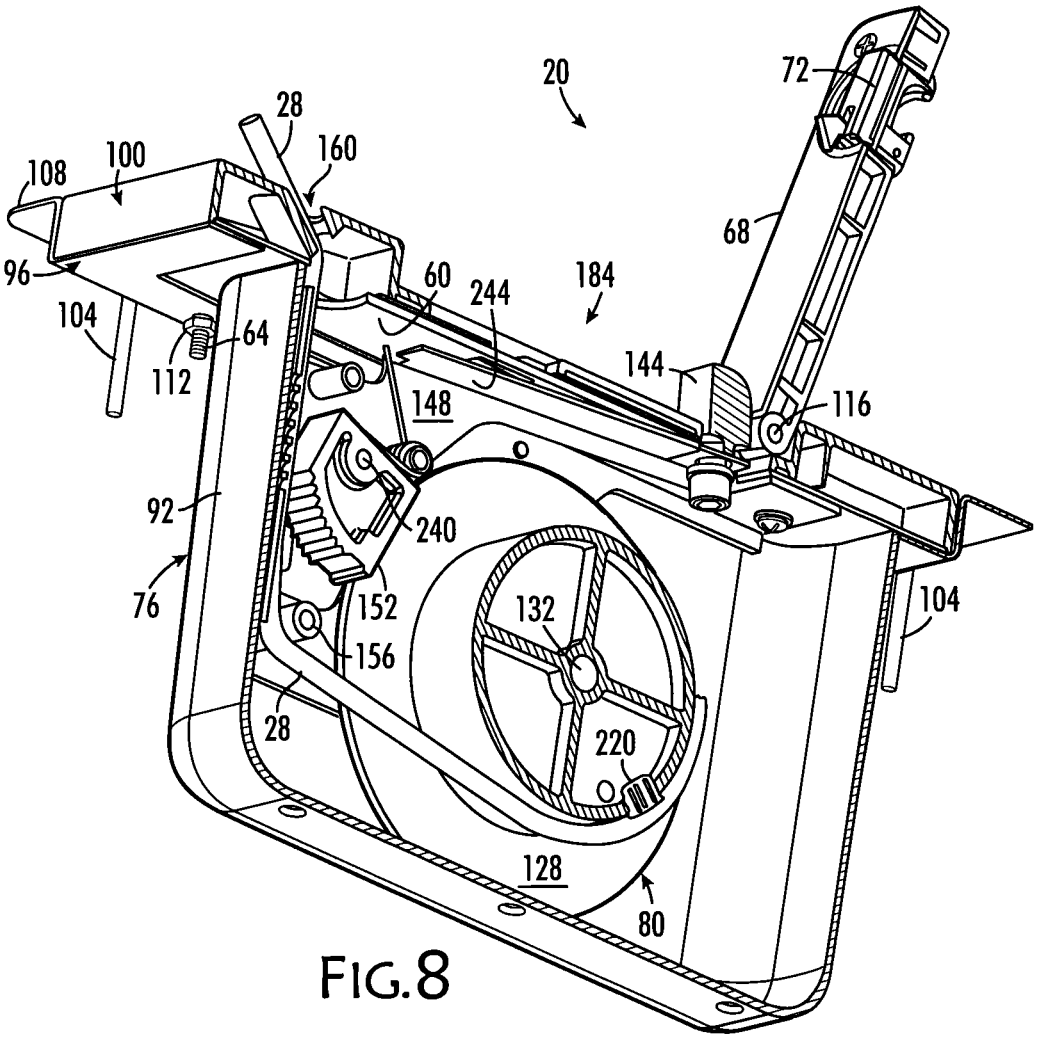
FIG. 8 is a left side, partial cross-sectional, lower rear perspective view of tethering device with latch arm shown up to show cam device, according to an aspect of the disclosure.

In FIGS. 7 and 8, both right, front, lower perspective view, partially cut away views of device 20, shows latch arm 68 raised to release plunger 144 (FIG. 5). Also visible is reel 128 with line 28 shown coming off, and locking arm 148 with its rearward end raised because latch arm 68 has released plunger 144 and thereby relieving return spring 140.

Comparing FIG. 7 with FIG. 8, both of which are partially cut away but showing different cross-sections image, plunger 144 is visible in FIG. 8 in its released position because latch arm 68 is raised, and one can also see cam 152 pivoted away from engagement with line 28. Cam 152 may have teeth 154, as shown, to grip line 28 better. Locking arm 148 is pivotally mounted proximate to an arm mount 232 (best seen in FIG. 10) and its proximal end carries toothed cam 152 and its distal end is positioned just below hole 160 (FIG. 8) in dock board 100. Plunger 144 is carried by distal end of locking arm 148, with respect to hole 160 for line 28, and extends through a hole 188 in cover plate 60 (see FIG. 11) and deck trim assembly 96 so that latch arm 68 can engage it. As latch arm 68 is moved from the unlatched (raised) position to the latched (lowered) position, latch arm 68 presses plunger 144 down onto proximal end of locking arm 148 causing its distal end to pivot counter-clockwise about a pivot latch pin 236. The counter-clockwise pivoting of locking arm 148 pushes cam 152 against line 28 to prevent further movement of line 28 as long as latch arm 68 is latched and plunger 144 is pressed down. A cam stopper pin 240 carried by locking arm 148 limits the distance cam 152 backs away from line 28 even when latch arm 68 is in the unlatched position and line 28 is free to retract.

Figure 9:
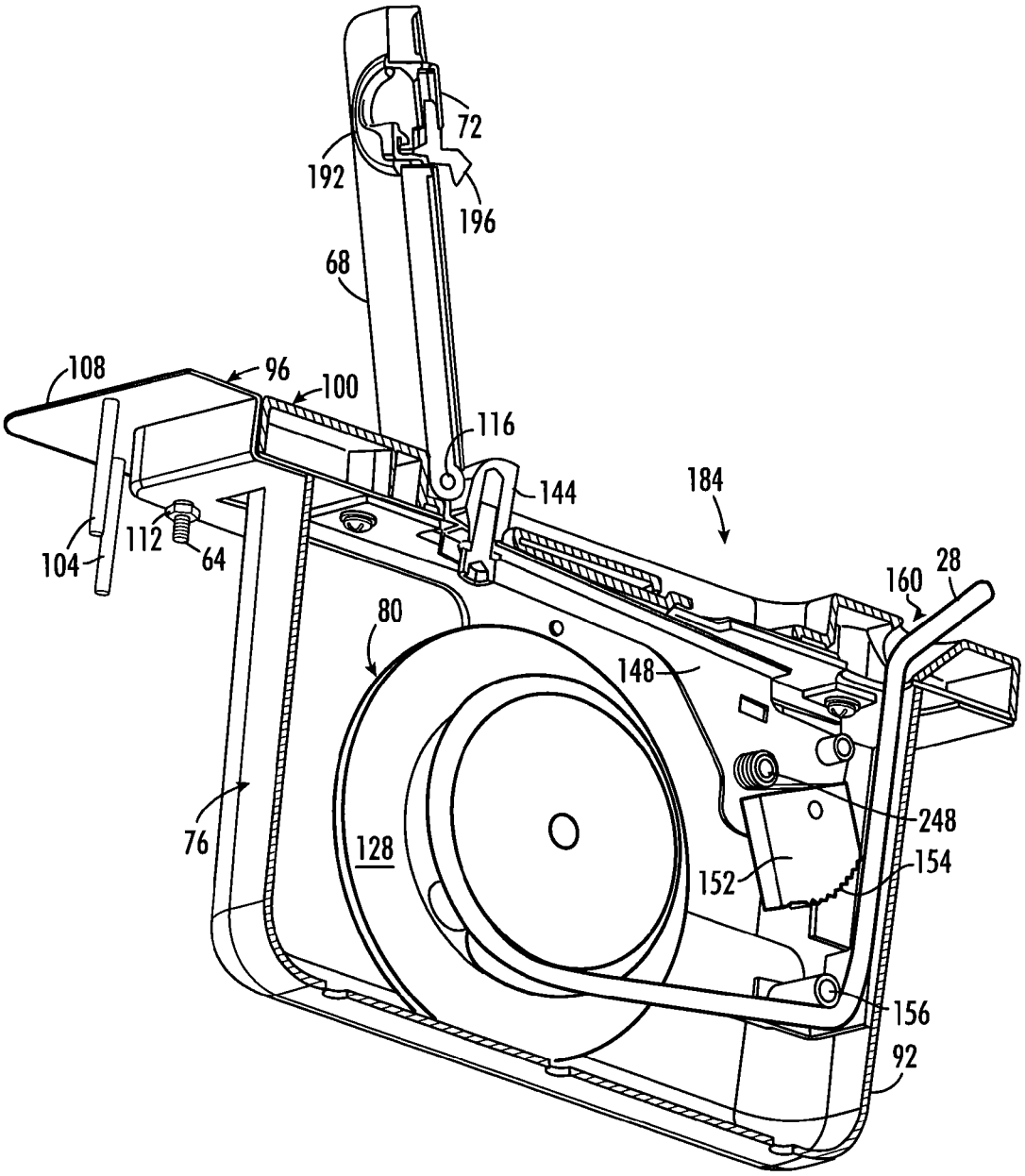
FIG. 9 is a right, rear perspective, cross-sectional, perspective view of the tethering system, showing the latch arm up to show the operation of the plunger and the cam, according to an aspect of the disclosure.
Figure 10:
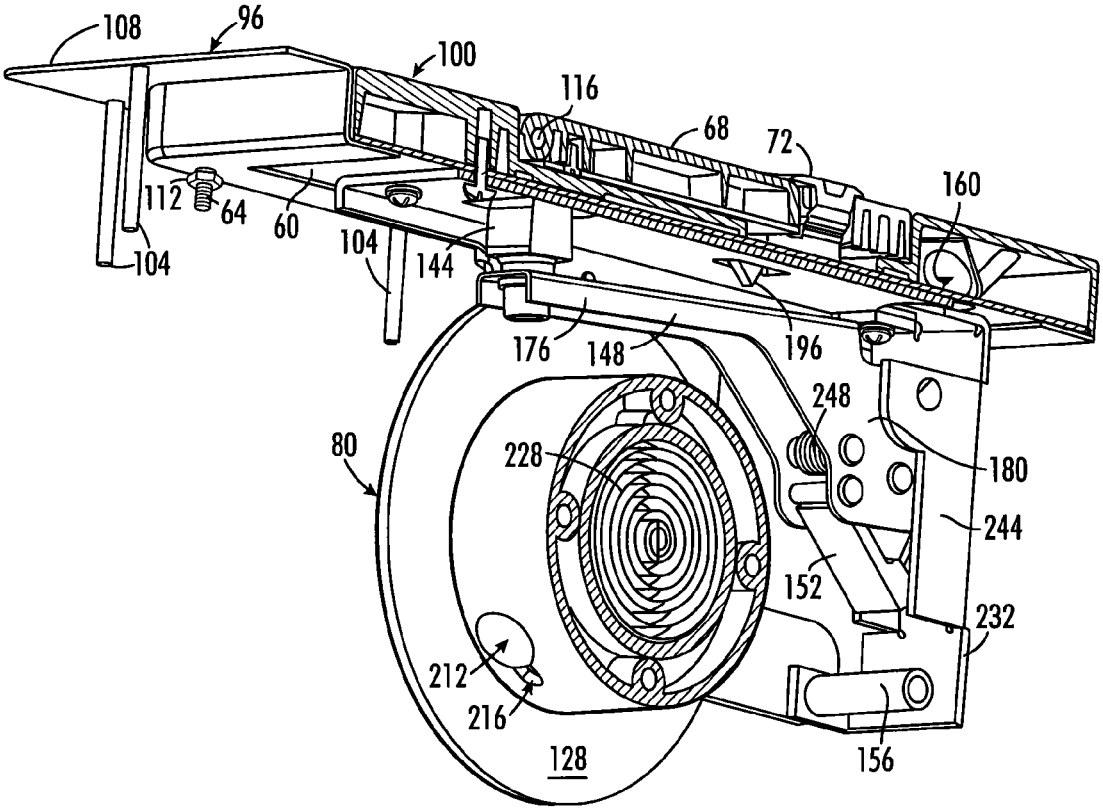
FIG. 10 is a right, rear perspective, cross-sectional view of the tethering device showing the assembly cover and line removed the take-up reel and showing the latch in its open position, according to an aspect of the disclosure.

As shown in FIGS. 9, 10, and 11, line 28 comes off line spool 80 of reel 128 and turns upward as it passes around line roller 156 to head toward hole 160 in dock board 100 at the top of device 20. Hole 160 may be beveled to reduce wear on line 28 as line 28 is pulled from, and retracts back into, device 20.

To assure that line 28 is always positioned so that it can be held by cam 152, an arm mount 232 is affixed to reel support frame 84 near to the inside surface of assembly cover 76 at proximal side 92. Arm mount 232 has two opposing flanges 244 that define a channel therebetween which channel is positioned so that line 28 runs directly and vertically through it, between opposing flanges 244, as line 28 passes around line roller 156 on its way to hole 160 in dock board 100. Cam 152, when so moved by the pivoting of locking arm 148 to the latched (closed) position, rotates into the channel defined by opposing flanges 244 and against line 28 to seize it and halt its movement.

FIGS. 9 and 10 are right side, rear, lower perspective, cross-sectional views of device 20. Reel 128 is visible in FIG. 9 as is cam 152. Second end 260 of return spring 140 is shown urging cam 152 away from line 28 as latch arm 68 is raised to the unlatched position. FIG. 10 shows latch arm 68 closed, plunger 144 depressed, and thereby also depressing distal end 176 of locking arm 148 down and raising proximal end 180 to drive cam 152 against line 28.

Latch arm 68 fits within in a recess 184 formed in dock board 100. As best seen in FIG. 11, a hole 188 is formed in recess 184 in dock board 100 (and a corresponding hole is in cover plate 60) that allows latch 72 to be operatively connected with a latch ring 192 on the end of latch arm 68 that is in turn connected with reel support frame 84 at a latch catch 196. A second hole 200 in recess 184 (and cover plate 60) allows latch arm 68 to communicate with plunger 144.

Inside assembly cover 76, retraction reel 128 retracts slack in line 28. Reel 128 includes a spool 80 rotatably mounted to axle 132. An end of line 28 is secured to line spool 80 at hole 212 (best seen in FIGS. 8 and 10) with a knotted end, which end is then slid down into narrower slot 216. Line plug 220 is installed into spool 80 to fasten line 28 to spool 80 and is then wound therearound. Running end 32 of line 28 passes around a line roller 156. Running end 32 of line 28 and line loop 34 extends through hole 160 in dock board 100. Line loop 34 in running end 32 of line 28 serves to prevent line 28 from being retracted by retraction reel 128 through hole 160 in dock board 100 and into assembly 20. Alternatively, a knot in running end 32 line 28 or an object to which running end 32 of line 28 is tied can serve the same purpose as long as the width of the knot or object is greater than the diameter of hole 160 so that running end 32 cannot be retracted back into device 20. Retraction is accomplished using a power coil spring in spring retractor 228 that is loaded by the withdrawal of a length of line 28 and relieved when allowed to retract line 28 onto spool 80.

The effects of return spring 140 and a cam biasing spring 248 will now be described. Return spring 140 urges locking arm 148 to rotate counter-clockwise when viewed from the right side of tethering device 20 (clockwise when viewed from the left side) so that plunger 144 is pushed up upon movement of latch arm 68 to the unlatched position. Conversely, closing latch arm 68 loads return spring 140. Locking arm 148, aided by a cam stopper pin 252 (FIG. 11), causes cam 152 to pivot into the channel between opposing flanges 244 of arm mount 232 and against line 28 when latch arm 68 is closed and cam biasing spring 248 pivots cam 152 away from line 28 when latch arm 68 is moved to the unlatched position.

Return spring 140 is a coiled spring with a first end 256 and an opposing second end 260 and that is fixed into position by clevis pin 264. First end 256 engages a catch 268 carried on locking arm 148 and movable therewith, so that first end 256 moves with the movement of locking arm 148. Second end 260 is held by a catch 272 on arm mount 232. As locking arm 148 is rotated clockwise (right view) about a pivot pin 276 by the downward movement of plunger 144, return spring 140 is loaded against catch 272 on arm mount 232. Counter-clockwise rotation of locking arm 148 relieves return spring 140. Return spring 140 is mounted on a clevis pin 280. First end 256 of return spring 140 is operated in notch 184 in locking arm 148 and second end 260 is applied against cam 152 so that return spring 140 is always urging cam 152 out of the channel in arm mount 232 and away from line 28. Locking arm 148 and return spring 140 ultimately control movement of cam 152 into the channel of arm mount 232. When latch arm 68 is in the latched position, tension on line 28 will act on cam 152 to further engage line 28, but when latch arm 68 is moved to the unlatched position, and locking arm 148 is moved away from line 28, return spring 140 pulls cam 152 from line 28.

Those familiar with docks and boating will appreciate that many modifications and substitutions can be made to the foregoing disclosure without departing from the spirit and scope of the invention, defined by the appended claims.

What is claimed is:

1. A tethering device, said tethering device comprising:

a line with a running end having a loop formed therein;

a retracting reel deploying said line when force is applied to said running end of said line and retracting said line when force is not applied to said running end of said line;

a reel frame, said retracting reel being secured to said reel frame;

a dock board having a top surface and a bottom surface, said reel frame being secured to said bottom surface of said dock board, and wherein a hole is formed in said dock board through which said running end of said line passes from said retracting reel to said top surface of said dock board;

a latch arm carried by said dock board, said latch arm having a top surface and a bottom surface, and a latched position and an unlatched position;

a cam connected to said latch arm at a point proximate to said line between said retracting reel and said hole in said dock board, wherein, when said latch arm is moved to said latched position, said latch arm moves said cam so as to engage and hold said line against movement, and wherein when said latch arm is moved to said unlatched position, said latch arm moves said cam away from said line and said line moves toward said retracting reel unless force is applied to said running end of said line;

a deck trim assembly having a top surface and a bottom surface, said deck trim assembly having a recess formed in said top surface, said recess being dimensioned to receive said dock board, and wherein, when said dock board is in said recess of said deck trim assembly, said top surface of said dock board is flush with said top surface of said deck trim assembly; and threaded studs secured to said bottom surface of said deck trim assembly, said threaded studs dimensioned to pass through decking of a boat dock.

2. The tethering device of claim 1, wherein said latch arm has a top surface and a bottom surface, and wherein said dock board has a recess formed therein and said latch arm lies in said recess when in said latched position, and said top surface of said latch arm is flush with said top surface of said dock board and said top surface of said deck trim assembly.

3. The tethering device as recited in claim 1, wherein said cam is configured to have teeth to grip said line.

4. The tethering device as recited in claim 1, wherein said decking is comprised of plural decking boards, a decking board of said plural decking boards having a width, and wherein said dock board has a width the same as said width of said decking board.

5. The tethering device as recited in claim 4, wherein said plural decking boards include parallel decking boards spaced apart by at least said width of said dock board, said dock board thereby fitting between said parallel decking boards, and wherein said deck trim assembly includes a flange extending laterally over at least a portion of said parallel decking boards.

6. The tethering device as recited in claim 1, further comprising an assembly cover surrounding said retracting reel, said reel frame, and said cam, wherein said assembly cover is attached to said bottom surface of said dock board.

7. The tethering device as recited in claim 1, further comprising an arm mount located proximate to said cam, said arm mount having two parallel flanges, said line running between said two parallel flanges to said hole in said dock board from said retracting reel.

8. The device as recited in claim 1, wherein said latch arm includes a plunger and a locking arm, wherein said locking arm has a distal end and a proximal end, said cam being carried by said proximal end of said locking arm, said plunger engaging said distal end of said locking arm and pivoting said proximal end of said locking arm when said plunger presses said distal end of said locking arm to bring said cam into engagement with said line when said latch arm is moved from said unlatched position to said latched position.

9. A tethering device, said tethering device comprising:

a line having a fixed end and a running end, said running end having a loop formed therein;

a deck trim assembly having a top surface and a bottom surface and a recess formed in said top surface, a dock board dimensioned to be received in said recess of said deck trim assembly, said dock board having a top surface and a bottom surface, and wherein, when said dock board is in said recess of said deck trim assembly, said top surface of said dock board is flush with said top surface of said deck trim assembly, and said top surface of said deck trim assembly extends laterally from said recess to define a flange, said dock board having a hole formed therein through which said line passes, with said running end above said top surface and said fixed end below said bottom surface of said dock board;

an assembly cover secured to said bottom surface of said dock board;

a retracting reel inside said assembly cover, said retracting reel deploying said line when force is applied to said running end of said line, and retracting said line when force is not applied to said running end of said line, said fixed end of said line being attached to said retracting reel;

a reel frame inside said assembly cover and secured to said bottom surface of said dock board, said retracting reel being secured to said reel frame;

a latch arm carried by said dock board, said latch arm having a latched position and an unlatched position and a proximal end and a distal end; and a cam connected to said proximal end of said latch arm at a point and is between said retracting reel and said hole in said dock board, wherein, when said latch arm is moved to said latched position, said latch arm moves said cam to engage and hold said line against movement, and wherein when said latch arm is moved to said unlatched position, said latch arm moves said cam away from said line and said line moves toward said retracting reel unless force is applied to said running end of said line.

10. The tethering device as recited in claim 9, wherein said dock board has a width that is the same as the width of a decking board of said boat dock.

11. The tethering device as recited in claim 9, wherein said deck trim assembly is securable to decking boards of a boat dock.

12. The tethering device as recited in claim 9, wherein said deck trim assembly has plural threaded studs attached to said bottom surface.

13. The tethering device of claim 9, wherein said retracting reel includes a spool around which said line is wound, said spool having a hole formed therein with a slot in communication with said hole in said spool, and wherein said fixed end has a knot tied therein receivable in said hole, and wherein said slot is larger than said line and smaller than said knot.

14. A tethering device for use with a boat dock, said tethering device comprising:

a line having a fixed end and a running end, said running end having a loop formed therein;

a deck trim assembly having a top surface and a bottom surface and a recess formed in said top surface;

a dock board dimensioned and configured to be received in said recess of said deck trim assembly, said dock board having a top surface and a bottom surface, and wherein, when said dock board is in said recess of said deck trim assembly, said top surface of said dock board is flush with said top surface of said deck trim assembly, and said top surface of said deck trim assembly extends laterally from said recess to define a flange, said dock board having a hole formed therein through which said line passes, with said running end above said top surface and said fixed end below said bottom surface of said dock board;

an assembly cover secured to said bottom surface of said dock board;

a retracting reel inside said assembly cover, said retracting reel deploying said line when force is applied to said running end of said line and retracting said line when force is not applied to said running end of said line, said fixed end of said line being attached to said retracting reel;

a reel frame secured to said bottom surface of said dock board inside said assembly cover, said retracting reel secured to said reel frame, and wherein a hole is formed in said dock board through which said running end of said line passes from said retracting reel to said top surface of said dock board; and a latch arm carried by said dock board, said latch arm having a latched position and an unlatched position, wherein, when said latch arm is moved to said latched position, said latch arm holds said line against movement, and wherein when said latch arm is moved to said unlatched position, said line moves toward said retracting reel unless force is applied to said running end of said line.

15. The tethering device of claim 14, wherein said latch arm has a top surface and a bottom surface, and wherein said dock board has a recess formed therein and said latch arm lies in said recess when in said latched position and said top surfaces of said latch arm, said dock board, and said deck trim assembly are flush when said latch arm is in said latched position.

16. The tethering device of claim 14, further comprising a locking arm, wherein said locking arm has a distal end and a proximal end, said latch arm being operatively connected to said distal end of said locking arm when said latch arm is moved between said latched position and said unlatched position, said locking arm pivots toward and away from said line.

17. The tethering device of claim 14, further comprising a cam operatively connected to said latch arm, said cam engaging said line when said latch arm is moved to said latched position and disengaging from said line when said latch arm is moved to said unlatched position.

18. The tethering device of claim 14, further comprising a locking arm pivotally connected to said latch arm, and wherein when said latch arm moves between said latched position and said unlatched position, said locking arm pivots between a position toward said line and away from said line, and wherein said proximal end of said locking arm carries a cam that engages said line when said locking arm moves toward said line and disengages from said line when said locking arm moves away from said line.

19. The tethering device of claim 18, further comprising a plunger carried by said dock board, said plunger coupling said latch arm and said locking arm, said plunger pushing said distal end of said locking arm down when said latch arm moves to said latched position from said unlatched position and wherein said plunger allows said distal end of said locking arm to rise when said latch arm is moved to said unlatched position.

20. The tethering device of claim 18, further comprising an arm mount carried by said assembly cover, said arm mount having two parallel flanges, said line running between said two parallel flanges and said cam holding said line between said two parallel flanges when said cam engages said line.

* * * * *